US006584039B1

(12) United States Patent
Purcell et al.

(10) Patent No.: US 6,584,039 B1
(45) Date of Patent: Jun. 24, 2003

(54) MULTI-MODE PIPE PROJECTOR

(75) Inventors: Christopher John A. Purcell, Dartmouth (CA); Richard A. Fleming, Tignish (CA)

(73) Assignee: Her Majesty the Queen in right of Canada, as represented by the Minister of National Defence, Ottawa (CA)

( * ) Notice: Subject to any disclaimer, the term of this patent is extended or adjusted under 35 U.S.C. 154(b) by 0 days.

(21) Appl. No.: 10/171,690

(22) Filed: Jun. 17, 2002

(51) Int. Cl.[7] ..... H04R 17/00
(52) U.S. Cl. ..... 367/176; 181/113
(58) Field of Search ..... 367/176, 141, 367/157, 162, 173; 181/113, 118, 120

(56) References Cited

U.S. PATENT DOCUMENTS 4,922,470 A 5/1990 McMahon et al.
5,047,997 A 9/1991 Forsberg
5,062,089 A 10/1991 Willard et al.
5,805,529 A 9/1998 Purcell
2003/0058741 * 3/2003 Franklin ..... 367/174

FOREIGN PATENT DOCUMENTS

CA 1319414 9/1988

* cited by examiner

*Primary Examiner*—Ian J. Lobo
(74) *Attorney, Agent, or Firm*—Larson & Taylor, PLC

(57) ABSTRACT

An underwater acoustic projector comprising a pair of spaced apart end plates with an acoustic driver positioned between the end plates, the driver having smaller cross-sectional dimensions than the end plates. Each end plate close one end of an open ended tubular pipe waveguide and that plate is mechanically connected to one end of a piezo-electric drive unit with a tubular waveguide extending inwards and surrounding the end portion of the acoustic driver.

17 Claims, 8 Drawing Sheets

MULTI-MODE PIPE PROJECTOR

FIELD OF THE INVENTION

The present invention relates to acoustic projectors, especially projectors for use in military and civilian sonar systems, and in particular to underwater acoustic projectors having stable performance with depth, an increased bandwidth and reduced manufacturing costs due to lower mechanical tolerances being required than in existing acoustic projectors.

BACKGROUND OF THE INVENTION

Military and civilian sonar systems require compact, light weight, high power, efficient, wide bandwidth acoustic projectors whose performance is stable with depth and linear with drive voltage levels and which have a low manufacturing and maintenance cost.

Canadian Patent 1,319,414 by Bryce Fanning et al that issued on Jun. 22, 1993 describes one type of a free-flooding piezoelectrically driven resonant-pipe projector (RPP) with vent holes in the pipe walls to broaden the response of certain cavity resonances and to increase the response between those resonances. The drive unit is a radially-poled lead zirconate-titanate cylinder with aluminum pipes extending into the center of the piezoelectric drive unit, the pipes being mechanically coupled to the drive unit. To accomplish the necessary acoustic coupling between the drive unit and pipes requires a close mechanical fit to couple the drive unit to the pipes. These resonant pipe projectors are partially free-flooding and can be operated at extreme depths because the drive unit is highly resistant to hydrostatic loading. However, the bandwidth is small and they are expensive to manufacture due to the close tolerances required.

Flextensional projectors are amongst the best ones presently available to meet the military and civilian sonar systems requirements, one example of a flextensional projector being the barrel stave type. The barrel stave projector (BSP) is a compact, low frequency underwater sound source which has applications in low frequency active (LFA) sonar and in underwater communications. In one known BSP design, such as described in U.S. Pat. No. 4,922,470 by G. McMahon et al, a set of curved bars (staves) surround and enclose a stack of axially poled piezoelectric rings located between end plates to which the staves are attached. The staves act like a mechanical transformer and help match the impedance of the transducer to the radiation impedance of the water. Axial motion of the stave ends is transformed to a larger radial motion of the stave midpoints. This increases the net volume velocity of the water, at the expense of the applied force, and is essential for radiating effectively at low frequencies.

This known BSP projector has slots between the staves which are required to reduce the hoop stiffness and achieve a useful transformer ratio. However, these slots must be waterproofed by a rubber membrane (boot) stretched tightly and glued with epoxy to the end plates. This boot also provides effective corrosion protection for the A1 staves. However, the variation in performance with depth of the BSP is suspected to depend in part on the boot. At increasing depths, hydrostatic pressure pushes the boot into the slots causing the shell to stiffen tangentially, increasing the resonance frequency, and causing an increasing loss of performance. This depth sensitivity of a barrel stave projector can be reduced somewhat by reinforcing the boot over the slots.

It is also possible to pressure compensate the BSP with compressed air or other gas resulting in good acoustic performance at greater depths.

The slots in the BSP, as a secondary effect, provide a nonlinearity in the response of the projector to hydrostatic loading. The staves will deflect inwards together under increasing hydrostatic loading (assuming no pressure compensation) since the projector is air filled. Depending on the thickness and stiffness of the rubber, it is reasonable to expect that as the slots close at great enough depths, that closure of the slots due to increasing depth will force the boot back out of the slots. The projector will now be very stiff and resistant to further effects of depth until the crush depth of the now, effectively, solid shell is reached. This provides a safety mechanism which may save the projector in case an uncompensated BSP is accidentally submerged very deep or a pressure compensation system runs out of air.

Variants of this known BSP have been built to optimise light weight, wider bandwidth, low frequency, high power, and improved electroacoustic efficiency. Efficiency is an especially critical parameter for the high power versions of the BSP because the driver is well insulated from the water thermally. The boot's relatively poor thermal conductivity contributes to the difficulty in cooling the BSP.

The inside surfaces of the (eight) staves of these BSPs are machined individually from bar stock on a numerically controlled (NC) milling machine. The staves are then mounted together on a fixture and the outside surfaces are turned on a tracer lathe. The machining and handling costs are such that the staves are the most expensive parts of the BSP. These BSPs are, as a result, both relatively costly to manufacture and maintain.

Since the radiating surface of this BSP is waterproofed with a rubber membrane, it is susceptible to chemical attack and degradation and damage due to flooding through pinholes. The BSP suffers from variation of performance with depth caused by water pressure forcing the rubber membrane into the slots between the vibrating staves of the projector unless a pressure compensation system is fitted. The BSP shows nonlinearity of performance versus drive voltage due to effects of the rubber membrane. Thus there could be substantial advantages to accrue if it were possible to develop a one-piece flextensional shell for the BSP that does not require a boot.

A one-piece flextensional shell projector is described by Christopher Purcell in U.S. Pat. No. 5,805,529. The surface of this projector is formed of a thin-walled one-piece inwardly concavely shaped shell containing corrugations (folds) running in the axial direction. This one-piece shell is slotless which eliminates the requirement for a boot. The shell, however, is of a complex shape and must be made with great precision. Therefore, it is expensive to manufacture and also has a limited crush depth.

SUMMARY OF THE INVENTION

It is an object of the invention to provide an acoustic projector with reduced depth sensitivity when submerged in water, improved bandwidth and reduced manufacturing costs.

An acoustic projector, according to one embodiment of the present invention, comprises a pair of spaced apart end plates with an acoustic driver positioned between and coupled to the end plates, the driver having smaller cross-sectional dimensions than the end plates which have tubular pipe waveguides extending towards and surrounding end portions of the driver, ends of said waveguides opposite said end plates being open and spaced apart.

BRIEF DESCRIPTION OF THE DRAWINGS

The invention will now be described in more detail with reference to the accompanying drawings, in which.

DESCRIPTION OF THE PREFERRED EMBODIMENTS

Military and civilian sonar systems require compact, light weight, high power, efficient, wide bandwidth acoustic projectors whose performance is stable with depth and linear with drive voltage levels as well as being low in cost to manufacture and maintain.

Flextensional projectors are amongst the best ones presently available to meet the requirements for military and civilian sonar systems. One type of flextensional projector, known as the barrel stave projector (BSP), is described in U.S. Pat. No. 4,922,470 by G. W. McMahon et al.

Another type of flextensional acoustic projector is described by Christopher Purcell in U.S. Pat. No. 5,805,529. This projector has a one-piece slotless flextensional shell for an underwater acoustic projector which is inwardly concavely shaped similar to the BSP but which does not require any boot. The one-piece shell has no gaps or openings in its outer surface. This shell achieves the required low hoop stiffness for low frequency operation by using folds rather than slots as used in the BSP. This Folded Shell Projector's (FSP) surface is formed of a thin-walled one-piece inwardly concavely shaped shell containing corrugations (folds) running in the axial direction. The corrugations extend between end flanges which are intended to be connected to end plates. Leads extend from a piezoelectric driver through a central opening in one of the end plates. The thin shell provides a waterproof enclosure for the driver in this type of projector but tight tolerances are required during the manufacture of this projector.

Figure 1:
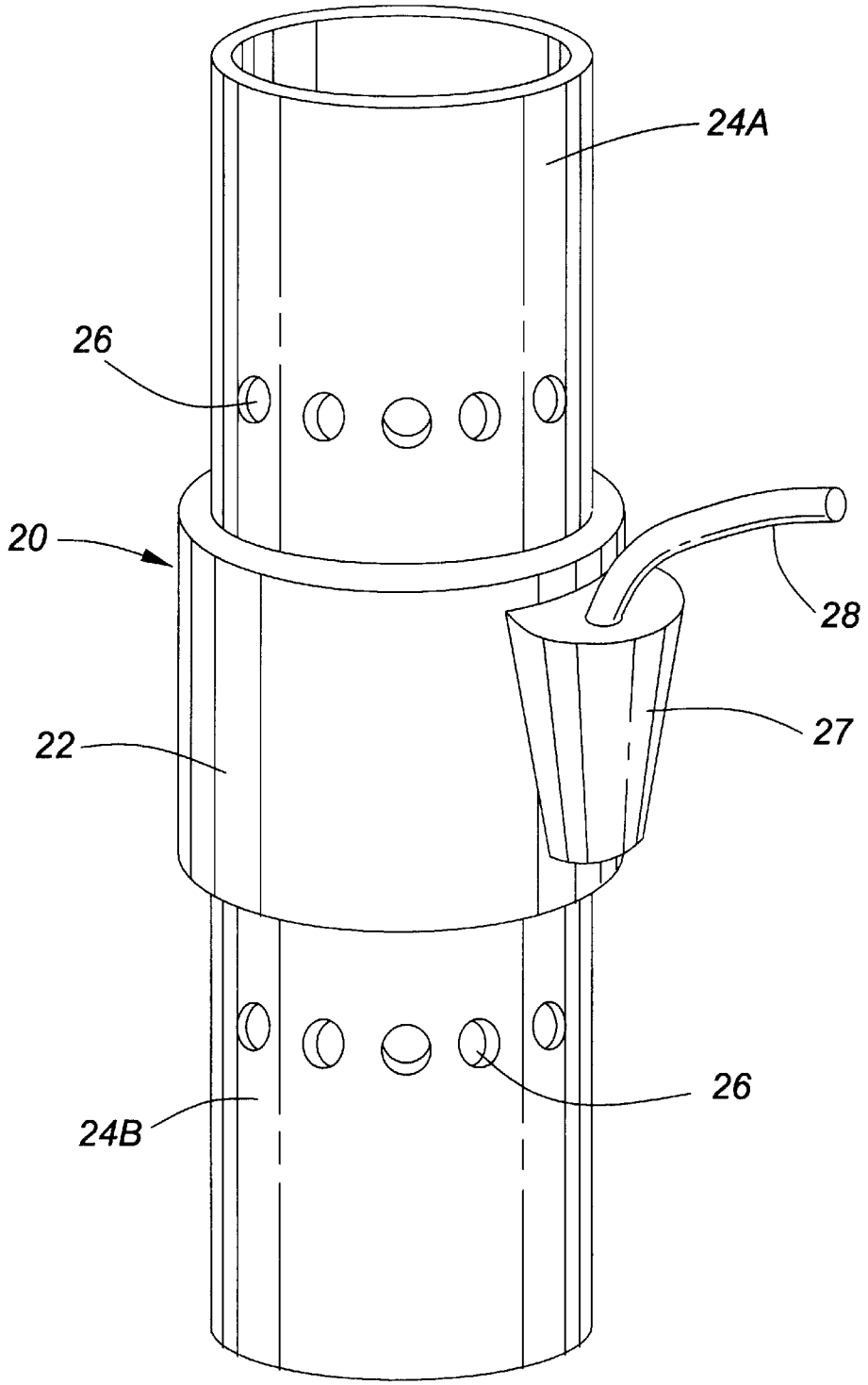
PRIOR ART FIG. 1
FIG. 1 is a perspective view of a known resonant pipe projector.

Canadian Patent 1,319,414 by Bruce Fanning et al which issued on Jun. 22, 1993 describes one known type of a partially free-flooding piezoelectric driven resonate pipe projector (RPP) which is illustrated in FIG. 1. This RPP 20 contains vent holes 26 in the pipe walls 24A and 24B to broaden the response of certain cavity resonances and to increase the response between those resonances. The drive unit 22 is a radially-poled lead zirconate-titanate cylinder with the aluminum pipes 24A and 24B extending into that cylinder where they are mechanically coupled to the inner surface of the drive unit. To accomplish the necessary acoustic coupling between the drive unit 22 and the pipes requires a close mechanical fit between those parts. This type of RPP are partially free-flooding and can be operated at extreme depths since the drive unit is highly resistant to hydrostatic loading. However, their bandwidth is small and they are expensive to manufacture due to the close mechanical tolerances required.

An axial drive resonant pipe projector (ADRPP) described in co-pending U.S. application Ser. No. 09/957,454, now allowed is a partially free-flooding acoustic projector that can be operated at extreme depths because the piezoelectric drive unit is highly resistant to hydrostatic loading. This ADRPP has a balanced pair of free flooded constant radius pipes (waveguides) with opposed open ends and integral end plates that are connected to opposite ends of a piezoelectric drive unit with pre-stress rods holding the end plates against the drive unit. This ADRPP is illustrated in the cross-sectional view of FIG. 2. This ADRPP is lightweight, compact and inexpensive to manufacture because the drive motor does not have to precisely fit the outside circumference of a resonant pipe as required in other RPPs such as those described in Canadian Patent 1,319,414.

Figure 2:
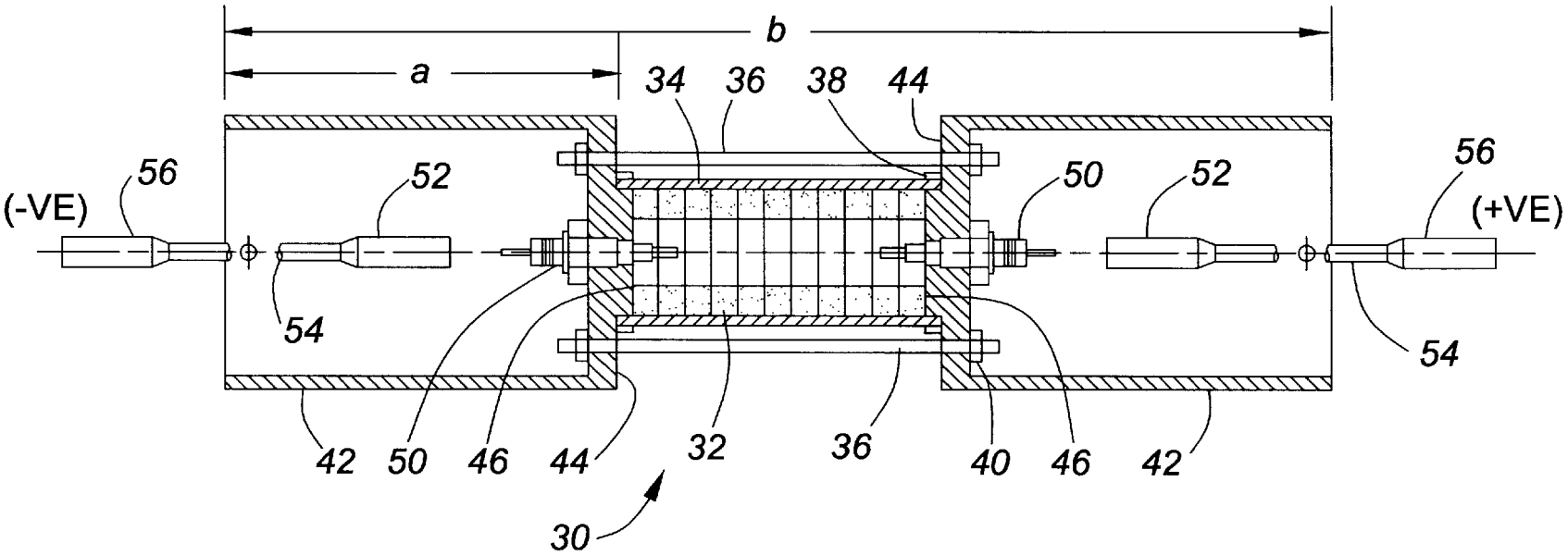
PRIOR ART FIG. 2
FIG. 2 is a cross-sectional view of an acoustic resonant pipe projector described in a co-pending application.

The axial drive resonant pipe projector 30 illustrated in cross-section in FIG. 2 contains a 12 ring ceramic stack piezoelectric drive element 32, the rings having nominal dimensions of 2 inch outer diameter, 0.4 inch axial length and 0.505 inch wall thickness. To watertight seal the stack 32 from sea-water, a 0.075 inch thick neoprene boot 34 was used to isolate the active components from seawater and it is bonded to the stack 32 by epoxy and restraining clamps 38 clamped on the central boss 46 of the end plates 44 at either end of the stack 32. An alternative to the neoprene boot is that one or more drive motors may be waterproofed by a coating. Although a stack of 12 ceramic rings are shown in FIG. 2, that number may be varied or a single piezoelectric cylinder used.

The waveguides 42 at opposite ends of the stack 32 consists of tubular pipes with open ends facing away from stack 32 and having integrally formed end plates 44, each end plate having a central boss 46 that presses against the ends of stack 32. That boss 46 serves a dual purpose in that (1) it serves to increase the plate thickness to maintain peak operational bending stresses in the end plate below the endurance limit of the aluminum end plate and (2) it facilitates the water-tight sealing of the neoprene boot 34 to stack 32. The end plates 44 are shown as being integrally formed with the tubular pipes but these could be formed separately and the central bosses 46 would not be necessary when the drive element is waterproofed with a coating rather than a boot.

The ADRPP projector described in that co-pending application Ser. No. 09/957,454 is lightweight, compact and inexpensive to manufacture compared to other projectors. The tuning of the longitudinal mode of this projector may be achieved by varying the length of the waveguides, the length of the motor, the end plate dimensions and the material properties. To lower the frequency of the operational band, low sound speed fluids may be sealed into the waveguide volumes by means of a flexible membrane covering their ends. The projector does have a narrow bandwidth but narrow band projectors are relative easy to power efficiently and, therefore, are highly suited to low cost battery operated expendable applications where a highly efficient sonar system (including amplifier, transformer and projector) is required.

The axial drive resonant pipe projector (ADRPP) described in that co-pending Canadian Application is substantially longer than the barrel stave projector (BSP) due to the waveguides and, as a result, would be impractical in applications where space is at a premium. By inverting the orientation of the ADRPP's waveguides, a more compact acoustic projector can be created. One such projector, a Multi-Mode Pipe Projector (MMPP) is illustrated in cross-section in FIG. 3 where the open ends of the waveguides 58 face each other and are spaced apart.

A MMPP prototype was designed with MAVART 14 software developed at Defence Research Establishment Atlantic, and the MMPP was optimized for a piezoelectric motor with the same physical dimensions as the ADRPP. This indicated that a MMPP type of projector would have a greater bandwidth than the ADRPP and have a simple construction, low cost and be significantly smaller. Since it is free flooding (with the exception of the motor interior) it would also be largely insensitive to the hydrostatic effects of depth.

Several MMPPs were created using 5 main assemblies of two waveguides 58 (see FIG. 3), two end plates 59 with drive motor mount bosses, and a drive motor 32. Separate waveguides and mount bosses were used for ease of assembly. Otherwise, the assembly would be impractical due to the two inward facing waveguides. The waveguides 58 and end plates 59 with mount bosses for the Mark 1 prototype were machined from 606IT-6 aluminium and tolerances were kept close to minimize losses in the assembled projector epoxy joints. Each waveguide 58 for the Mark 1 prototype had a 2.040 inch height, a 3.500 inch outside diameter and a 0.200 inch wall and end plate thickness.

Figure 3:
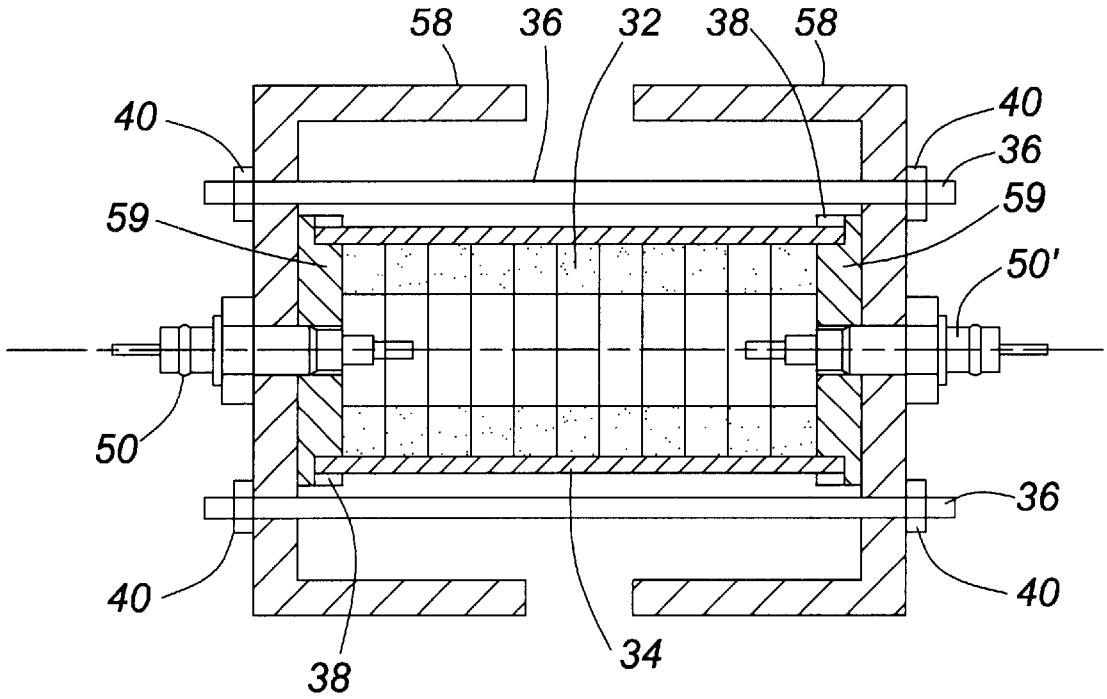
FIG. 3 is a cross-sectional view of a Multi-Mode Pipe Projector (MMPP) Mark 1 according to one embodiment of the present invention.

The MMPP Mark 1 is illustrated in cross-section in FIG. 3. To assemble the MMPP Mark 1, a watertight projector boot 34 was first stretched over the drive motor (piezoelectric stack 32). The drive motor leads were then fed through the central hole in each of the motor mount bosses and end plates 59 and the boot 34 is clamped in place on the mount bosses by clamps 38. The waveguides 58 were aligned by passing four ⅛" stainless steel stress rods 36 through aligned holes in the closed ends (circular plates) of waveguides 58 with nuts 40 being threaded onto ends of rods 36 and tightened down. This assembled projector weighed 1.410 kg of which 0.7846 kg was due to the drive motor.

Figure 4:
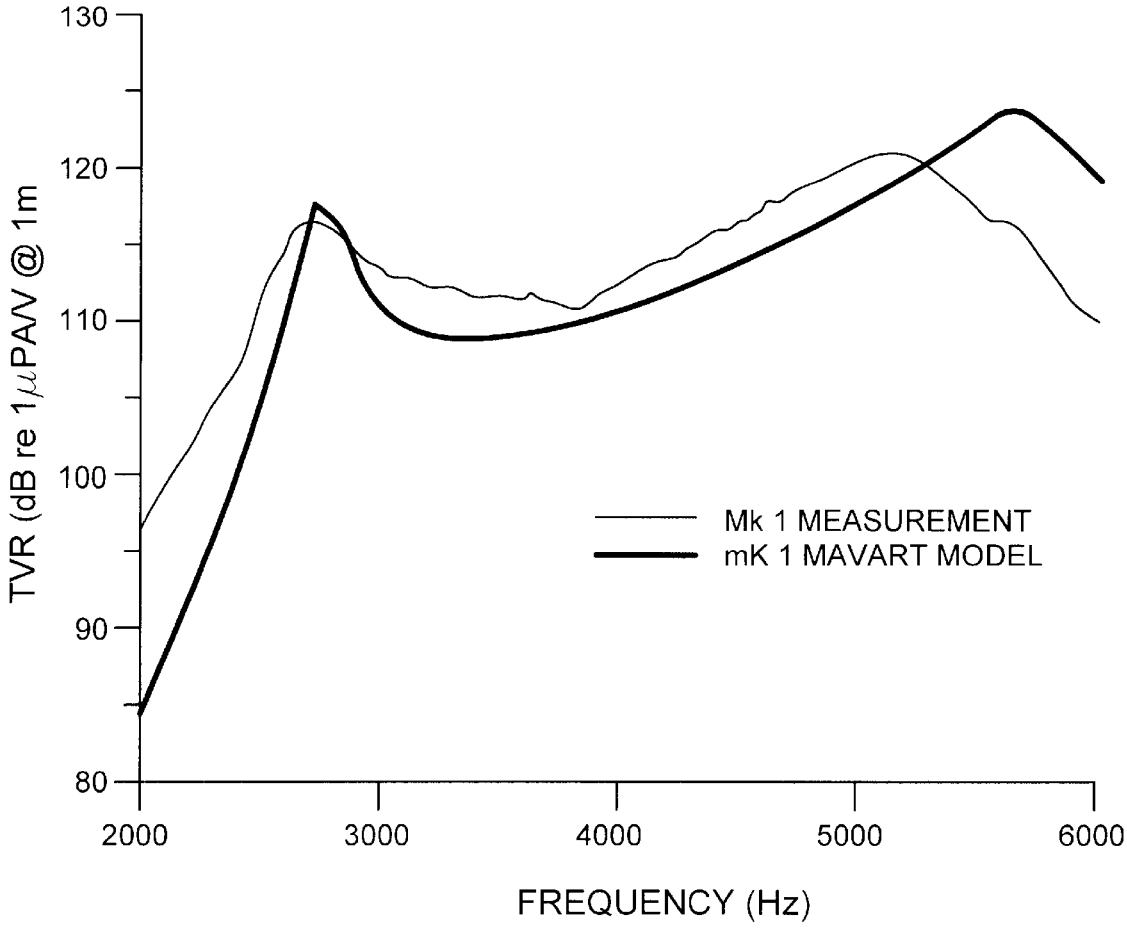
FIG. 4 is a graph showing the frequency response of the MMPP Mark 1 over a frequency range of 2000 to 6000 Hz and a predicted response for that projector.

The Mark 1 MMPP was tested over a frequency range of 2 to 6 kHz and was found to have two major peaks out of the slot between the waveguides in the radial direction. The frequency response of the Mark 1 prototype is shown in the graph of FIG. 4 along with calculated responses predicted by the MAVART model. The first resonance was a 2 kHz wide response with its peak at 2.61 kHz (Q~4.45) and a peak Transmitting Voltage Response (TVR) of 116.5 dB. The following equations relate the TVR and drive voltage V to source level (SL), power, directivity index (DI in dB) and mass figure of merit (FOM).

$$SL = TVR + 20\ \log V\ (\text{dB } re\ 1\ \mu\text{Pa@1 m}) \quad (1)$$

$$POWER = 10^{((SL-171-DI)/10)}(W) \quad (2)$$

$$FOM = POWER/(mass(\text{kg})\cdot f_r(\text{kHz})\cdot Q\ (W\ \text{kg}^{-1}\text{kHz}^{-1}) \quad (3)$$

Over the −6 dB down band of the first peak, the maximum source level was 188.5 dB at 4 kVrms. Since the TVR value is referenced to 1 volt and the maximum source level is the actual sound pressure at a given drive voltage V, the SL is given in units of dB re 1 $\mu$Pa@1 m. The maximum DI was −6.3 dB so the power output was 240 watts. This gives a FOM of 14.7.

The second resonance of the Mark 1 MMPP was at 5.375 kHz with a peak TVR of 121 dB. This illustrates that the Mark 1 MMPP can generate a source level exceeding 182.5 dB at 1 m with a 4 kVrms input over a range of 2.48 to 5.85 kHz. The predicted TVR was in close agreement with the measured one as illustrated by the graphs in FIG. 4. The Mark 1 MMPP was also tested for changes in resonant frequency as a function of depth over increments between 10 m and 30 m and found to be very insensitive to depth change as no discernible frequency shifts were detected.

The third expected resonant mode for the Mark 1 MMPP would be too high in frequency to contribute significantly to the bandwidth of the projector. It would be necessary to lower the effective hoop stiffness of the waveguide in order to lower the frequency of the third resonant mode. This could be accomplished geometrically as in the folded shell projector or by using a compliant material in the waveguides, or by using flared sections on the waveguides.

Materials with lower moduli of elasticity for the waveguide material were investigated using MAVART modelling. The waveguide and end plate were first modelled utilizing various plastics but the acoustical output was found to be very low due to excessive bending in the end plate. The waveguides were then modelled using polymers, with the endcaps remaining metallic. Though the modelled peak output was lower than the Mark 1 MMPP, the first and second resonance modes were suppressed such that the previous mode 3 became the lowest resonance. The operational bandwidth was increased because this change introduced overlapping families of waveguide breathing modes and ceramic motor breathing modes.

Figure 5:
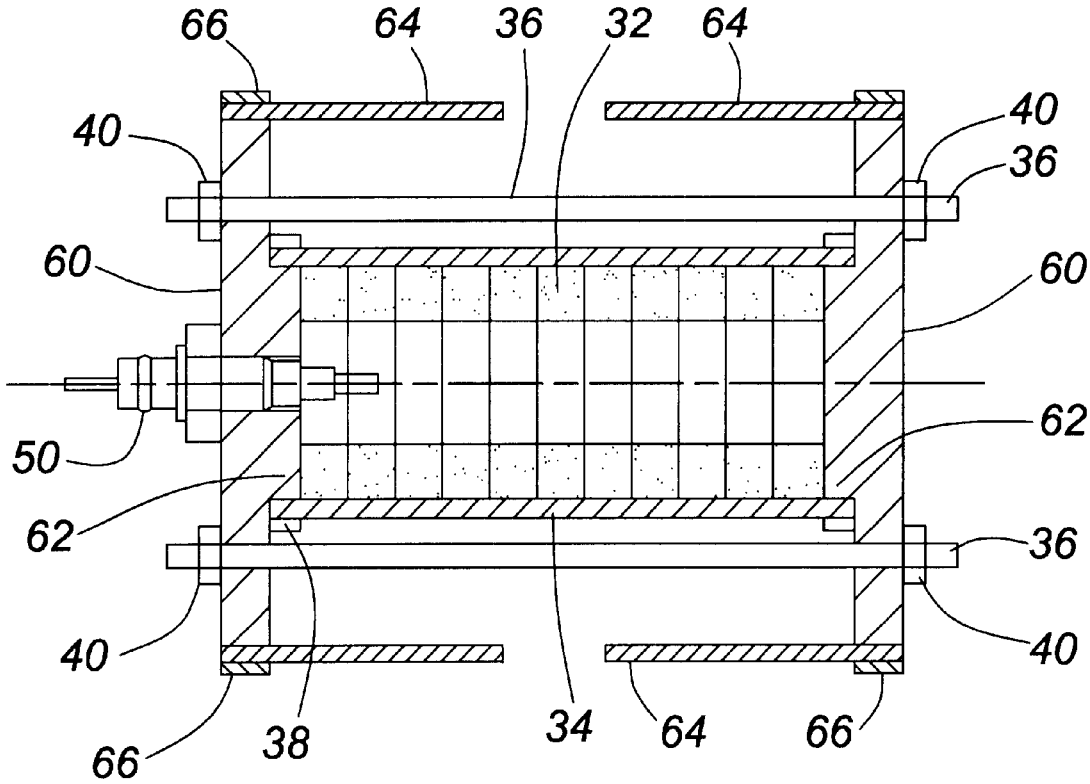
FIG. 5 is a cross-sectional view of a MMPP Mark 2 according to another embodiment of the present invention.

To assemble a Mark 2 MMPP having polymer waveguides and metallic endcaps, the Mark 1 version was dissembled so that the already well characterized drive motor could be used in the Mark 2 design which is illustrated in the cross-sectional view of FIG. 5. The stainless steel end plates 60 was machined from 4 inch diameter solid stock. The polyvinyl chloride (PVC) waveguides 64 was machined from 3.5 inch schedule 40 PVC pipe. Prestress rod holes were drilled into the end plates 60 and two wire lead holes were drilled into one end plate. Four ⅛ inch stainless steel prestress rods 36 were cut and threaded with 5–40 threads and covered with heat shrinkable tubing. The heat shrinkable tubing reduces the probability of rod to drive motor arcing. FIG. 5 illustrates an arrangement with the stress rods 36 placed outside of the motor 32 but the stress rods may be placed inside of the piezoelectric stack. Both arrangements were used in the MMPP prototypes. The stress rods may employ Belleville springs to increase their compliance.

Figure 6:
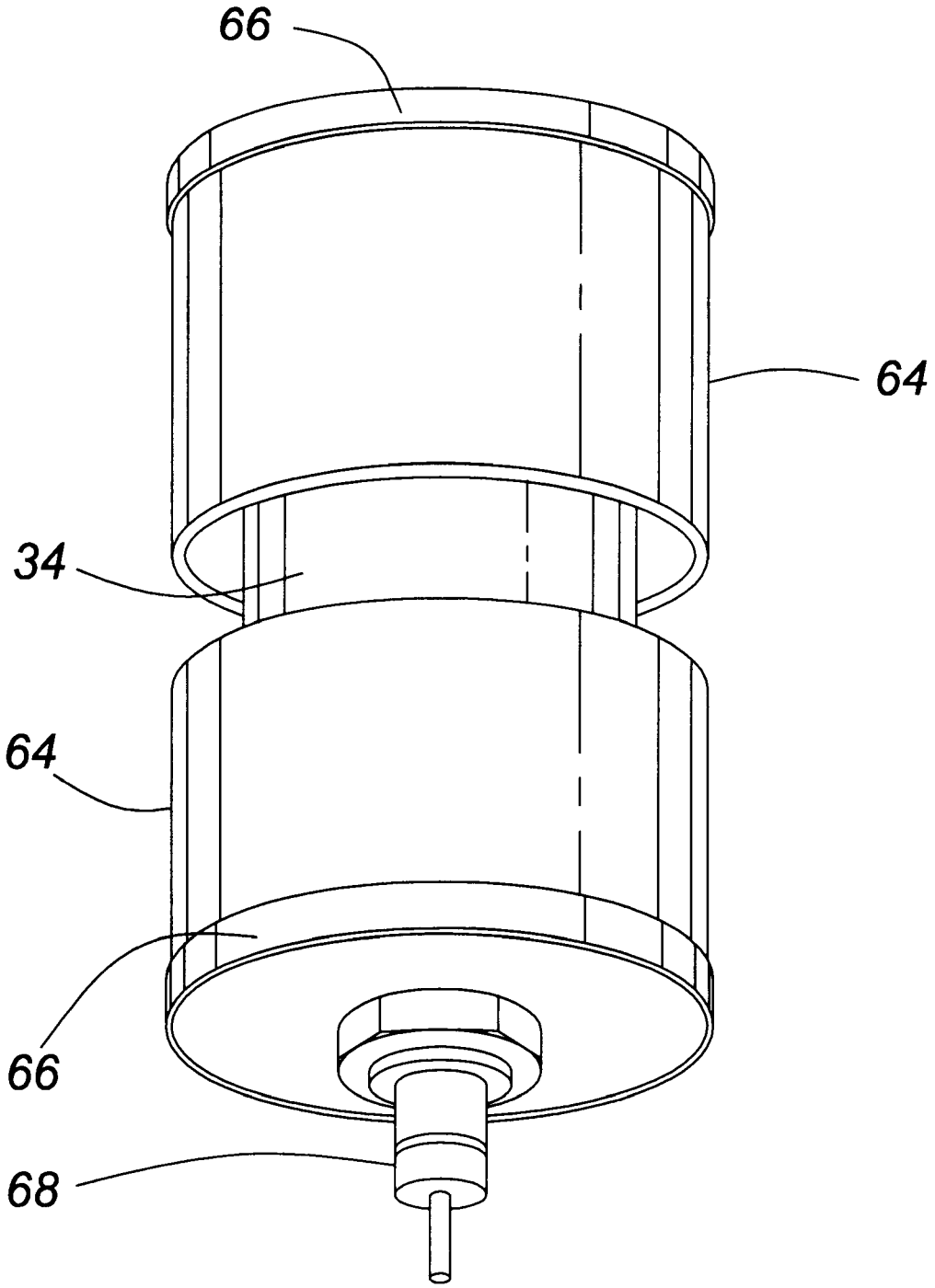
FIG. 6 is a perspective view of the MMPP Mark 2 embodiment.

A neoprene boot 34 was placed over the drive motor 32 to provide a watertight seal once the ends of the boot are sealed to bosses 62 on the end plates 60. The two PVC waveguide 64 surfaces that are to be joined to the end plates 60 were roughened and slid over the end plates 60 towards each other and then bonded to the end plates with a high strength epoxy. The joint between the waveguide and each end plate were clamped securely with an external circumferential ¼ inch clamp 66. The completed assembly of the Mark 2 MMPP is illustrated in the perspective view of FIG. 6, where the stress rods are located inside of the piezoelectric stack.

The Mark 2 MMPP assembled mass was 2.28 kg with a total length of 2.894 inches and an outside diameter of 3.475 inches and an inside diameter of 3.239 inches.

Figure 7:
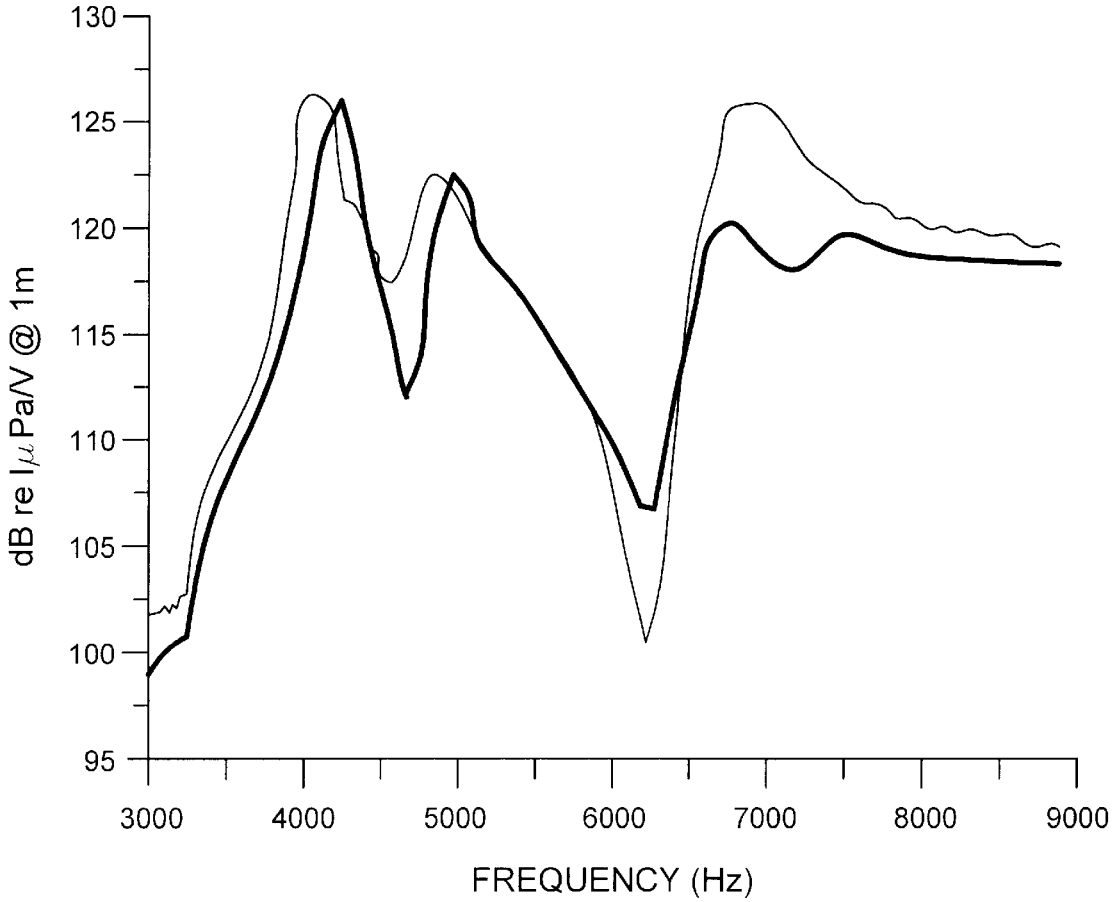
FIG. 7 is a graph showing the frequency response of the MMPP Mark 2 embodiment over a frequency range of 3000 to 9000 Hz and a predicted response for that projector.
Figure 8:
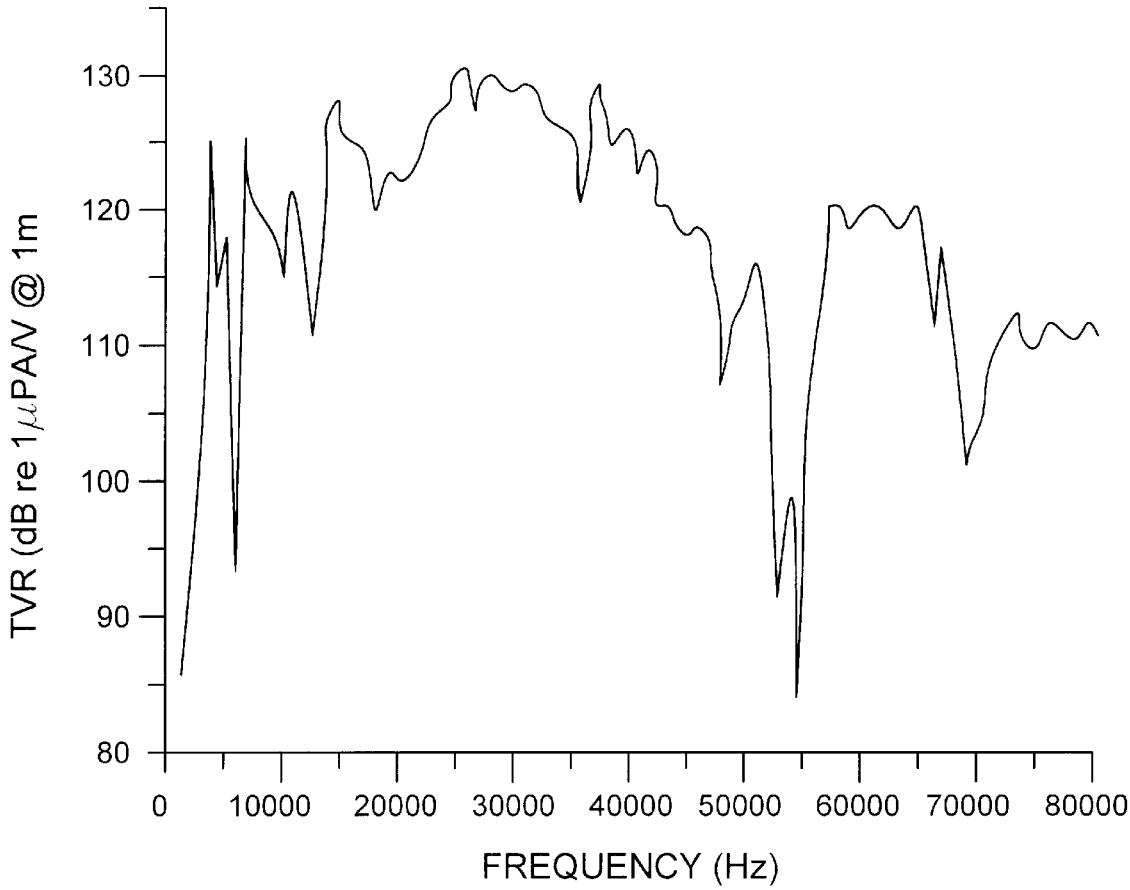
FIG. 8 is a graph showing the frequency response of the MMPP Mark 2 embodiment up to 80000 Hz.

The Mark 2 MMPP was tested from 3 to 9 kHz and found to have a flat response near 9 kHz as illustrated by the graphs in FIG. 7, the measured frequency response being close to the predicted response. Testing at higher frequencies demonstrated an extraordinary frequency response which is shown in the graph in FIG. 8. The testing showed significant acoustical output power from 4 to 47.5 kHz with another band from 57 to 67 kHz. In the lower band, only two narrow dips were noted below 116 dB.

The Mk 2 MMPP was also tested for depth dependence and no significant frequency shift was found over a depth range of 10 to 160 meters.

Various modifications may be made to the preferred embodiments without departing from the spirit and scope of the invention as defined in the appended claims. The waveguides, for instance, may be sealed at the ends which are remote from the end plates by thin flexible polymer membranes and filled with a fluid having a lower sound speed than the surrounding medium such as a fluorosilicone oil to lower the resonant frequency. A single waveguide could be applied to only one end of the acoustic projector, with less benefit than application to both ends, but still producing a gain in bandwidth.

The embodiments of the invention in which an exclusive property or privilege is contained is claimed are defined as follows:

1. An acoustic projector comprising a pair of spaced apart end plates with an acoustic driver positioned between and coupled to the end plates, the driver having smaller cross-sectional dimensions than the end plates which have tubular pipe waveguides extending inwards and surrounding end portions of said driver, ends of said waveguides opposite said end plates being open and spaced apart.

2. An acoustic projector as defined in claim 1, wherein the end plates are metallic and contain apertures, stress rods with threaded ends extending through aligned apertures in the spaced apart end plates and locknuts on threaded portions of the stress rods press the end plates towards each other and against the acoustic driver.

3. An acoustic projector as defined in claim 2, wherein the acoustic driver is a stack of piezoelectric rings and each end plate has a circular central boss that extends toward and presses against said stack.

4. An acoustic projector as defined in claim 3, wherein said stack is surrounded by a waterproof boot having each end fastened to one of said central bosses by a clamp.

5. An acoustic projector as defined in claim 4 wherein electrical connectors extend through an opening in one end plate to provide electrical connections to said rings, the connectors being sealed to the associated end plate in a waterproof manner.

6. An acoustic projector as defined in claim 1 wherein the tubular waveguides are polymer tubes and the end plates are metallic.

7. An acoustic projector as defined in claim 6, wherein the polymer is polyvinyl chloride.

8. An acoustic projector as defined in claim 6, wherein the metallic end plates are stainless steel end plates.

9. An acoustic projector as defined in claim 2, wherein the tubular waveguides are polymer tubes.

10. An acoustic projector as defined in claim 2, wherein the metallic end plates are stainless steel end plates and the tubular pipe waveguides are polyvinyl chloride tubes.

11. An acoustic projector as defined in claim 2, wherein the tubular pipe waveguides are metallic.

12. An acoustic projector comprising a pair of spaced apart end plates with an acoustic driver positioned between and coupled to the end plates, the driver having smaller cross-sectional dimensions than the end plates, at least one end plate having a tubular pipe waveguide extending towards and surrounding an end portion of the said driver.

13. An acoustic projector as defined in claim 12, wherein an end of said tubular pipe waveguide remote from its associated end plate is sealed with a polymer membrane and that waveguide is filled with a fluid having a lower sound speed than the surrounding medium.

14. An acoustic projector as defined in claim 12, wherein the end plates and waveguides are metallic and the ends of the waveguides adjacent to the end plates are closed with integral formed circular plates in contact with an outside surface of an associated end plate, the circular plates containing apertures with stress rods having threaded ends extending through aligned apertures in the circular plates, locknuts on threaded portions of the stress rods pressing the circular plates towards each other and against an outer surface of an associated end plates.

15. An acoustic projector as defined in claim 14, wherein the acoustic driver is a stack of piezoelectric rings and each end plate has a circular central boss that extends towards and presses against said stack.

16. An acoustic projector as defined in claim 15, wherein said stack is surrounded by a waterproof boot having each end fastened to one of said end plates.

17. An acoustic projector comprising a pair of spaced apart end plates with an acoustic driver positioned between and coupled to the end plates, the driver having smaller cross-sectional dimensions than the end plates which have tubular pipe waveguides extending towards and surrounding end portions of said driver, ends of said waveguides opposite said end plates being spaced apart and sealed with a polymer membrane, the waveguide being filled with a fluid having a lower sound speed than the surrounding medium.

* * * * *